US006965310B1

(12) United States Patent
Hoben et al.

(10) Patent No.: US 6,965,310 B1
(45) Date of Patent: Nov. 15, 2005

(54) REMOTE NOTIFICATION METHOD

(75) Inventors: John Charles Hoben, Sugarland, TX (US); Allen Westmoreland, Sugarland, TX (US); Larry Fly, Dripping Springs, TX (US)

(73) Assignee: Gauging Systems, Inc., Sugar Land, TX (US)

( * ) Notice: Subject to any disclaimer, the term of this patent is extended or adjusted under 35 U.S.C. 154(b) by 0 days.

(21) Appl. No.: 10/678,572

(22) Filed: Oct. 3, 2003

Related U.S. Application Data

(60) Provisional application No. 60/416,046, filed on Oct. 4, 2002.

(51) Int. Cl.[7] ..... G08B 1/00

(52) U.S. Cl. ..... 340/531; 340/568.1; 340/568.2; 340/568.5; 340/569; 340/570; 340/571; 702/81; 702/82

(58) Field of Search ..... 340/531, 568.1, 340/568.2, 568.5, 569, 570, 571; 702/81, 702/82

(56) References Cited

U.S. PATENT DOCUMENTS

2002/0044055 A1 * 4/2002 Maloney ..... 340/571
2002/0121905 A1 * 9/2002 Salmon, Jr. ..... 324/602
2003/0011466 A1 * 1/2003 Samuel et al. ..... 340/5.73

* cited by examiner

*Primary Examiner*—Tai T. Nguyen
(74) *Attorney, Agent, or Firm*—Buskop Law Group, P.C.; Wendy Buskop

(57) ABSTRACT

The method for identifying the presence of an item to a user interface entails using a container having a loading opening and a collection opening, passing the item through the loading opening activating a first sensor, sending a first signal from the first sensor to an intelligent device, creating a first intelligent device signal from the intelligent device, communicating the first intelligent device signal to a communication system, opening the collection opening to collect the item, thereby activating a second sensor, sending a second signal from the second sensor to the intelligent device, creating a second intelligent device signal from the intelligent device, communicating the second intelligent device signal to the communication system, and using a software interface to process the first intelligent device signal and the second intelligent device signal and present the intelligent device signals processed by the software interface to the user interface.

17 Claims, 2 Drawing Sheets

REMOTE NOTIFICATION METHOD

This application claims the benefit of Provisional Application No. 60/416,046, filed Oct. 4, 2002.

FIELD OF THE INVENTION

The present method relates to a method for identifying items present or not present in a container to a user interface.

BACKGROUND OF THE INVENTION

The present method relates to a remote notification system concerning the status of containers in remote locations, and more particularly, to the automatic notification to a remote station or operator in response to whether a container has a package and whether that package has been removed.

It is important in the tracking of numerous remote containers, such as common carrier drop boxes, group mail collection sites, federal post office boxes, and private postal boxes, to know when packages have been dropped into the box and picked up. The ability to know whether a given container is full or empty reduces the time it takes to check each box individually, especially eliminating the time taken to empty the boxes.

Cutting down on the number of trips necessary to these remote container locations would reduce wear on vehicles, reduce gasoline wasted on the delivery/pick-up trucks, and increase the overall pick-up efficiency, especially operator time spent in checking and re-checking empty container boxes. Further, a fewer number of delivery trips to the containers would reduce the danger to the drivers and others that occur on the roads.

In addition, since the status of whether a container has a package or not is known and extra trips to check boxes are reduced, companies can afford to install more boxes at more locations, thereby increasing coverage to better serve the consumers. The notification also allows user to be alerted when vandalism has occurred to the containers and allow the user to quickly notify the police.

The object of the present method, therefore, is to provide a new and improved technique for notification to a user of the status of remote containers as to whether the container has a package or is empty.

Other advantages of the present method will become apparent as the following description proceeds, and the features characterizing the method will be pointed out with particularity in the claims annexed to and forming a part of this specification.

SUMMARY OF THE INVENTION

The present embodiment is a method for automatically identifying the presence of an item in a container to a user interface. When an item is placed in a container, a sensor is activated that sends a first signal to an intelligent device. The intelligent device sends a signal to a communication system. When the item is removed from the container, a second sensor is activated that sends a second signal to an intelligent device. The intelligent device sends a second signal to a communication system. Using a software interface, the intelligent device signals are processed. A user interface, then, transmits the processed signals to a user by Internet, Intranet, phone, fax, or pager.

BRIEF DESCRIPTION OF THE DRAWINGS

The present method and system will be explained in greater detail with reference to the appended Figures, in which.

Figure 1:
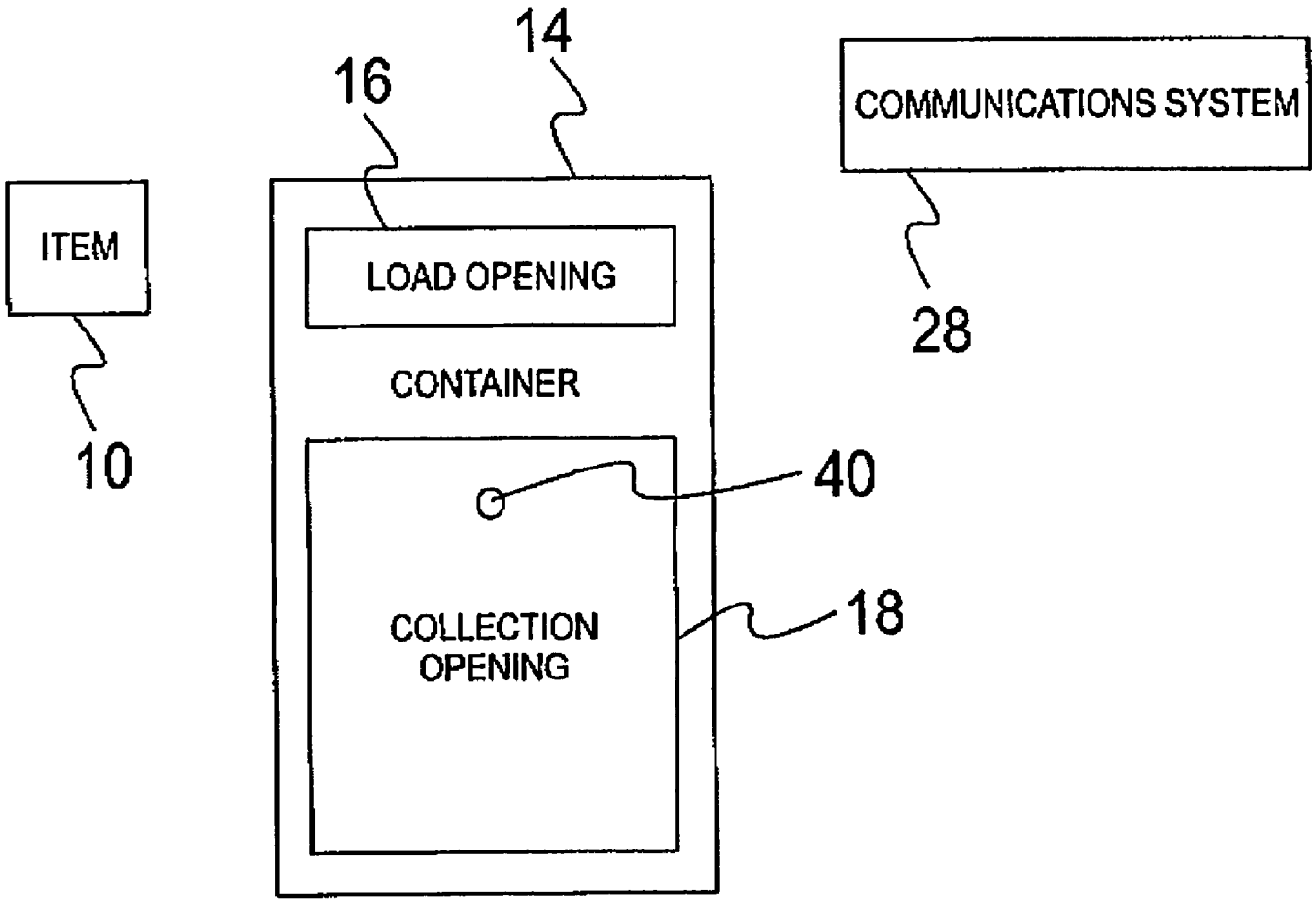
FIG. 1 is a view of the container.

The present method is detailed below with reference to the listed Figures.

DETAILED DESCRIPTION OF THE PREFERRED EMBODIMENTS

Before explaining the present method in detail, it is to be understood that the method is not limited to the particular embodiments and that it can be practiced or carried out in various ways.

In the preferred embodiment, the present embodiment is a method for identifying the presence of an item (10) to a user interface. The method is shown in detail in FIG. 1 and FIG. 2.

The method involves using a container (14) having a loading opening (16) and a collection opening (18). A user places the item (10) in the container (14) passing the item (10) through the loading opening (16) activating a first sensor (20). The first sensor (20) sends a first signal (22) to an intelligent device (24). The intelligent device (24) creates a first intelligent device signal (26) that it sends to a communication system (28). The communication system (28) is a radio, cellular, fiber optic, satellite, or wire system. The item (10) is collected through the collection opening (18), having a knob, handle, or key lock (40), thereby activating a second sensor (32). The second sensor (32) sends a second signal (34) to the intelligent device (24). The intelligent device (24) creates a second intelligent signal (36) that it sends to the communication system (28). A software interface processes the first intelligent device signal (26) and the second intelligent device signal (36) and presents the first intelligent device signal (26) and the second intelligent device signal (36) processed by the software interface to the user interface (50). The user interface (50) is the Internet, Intranet, phone, fax, and pager.

The item (10) in the method can be a package. The second sensor (32) can be manually operated to indicate the collection opening (18) has been opened.

In another embodiment, the method includes the step of using one opening as the loading opening (16) and the collection opening (18), as seen in FIG. 1. The method can also involve the step of using a counter with the intelligent device (24) to store sensor activity and report to the user interface (50) on a timed basis.

Figure 2:
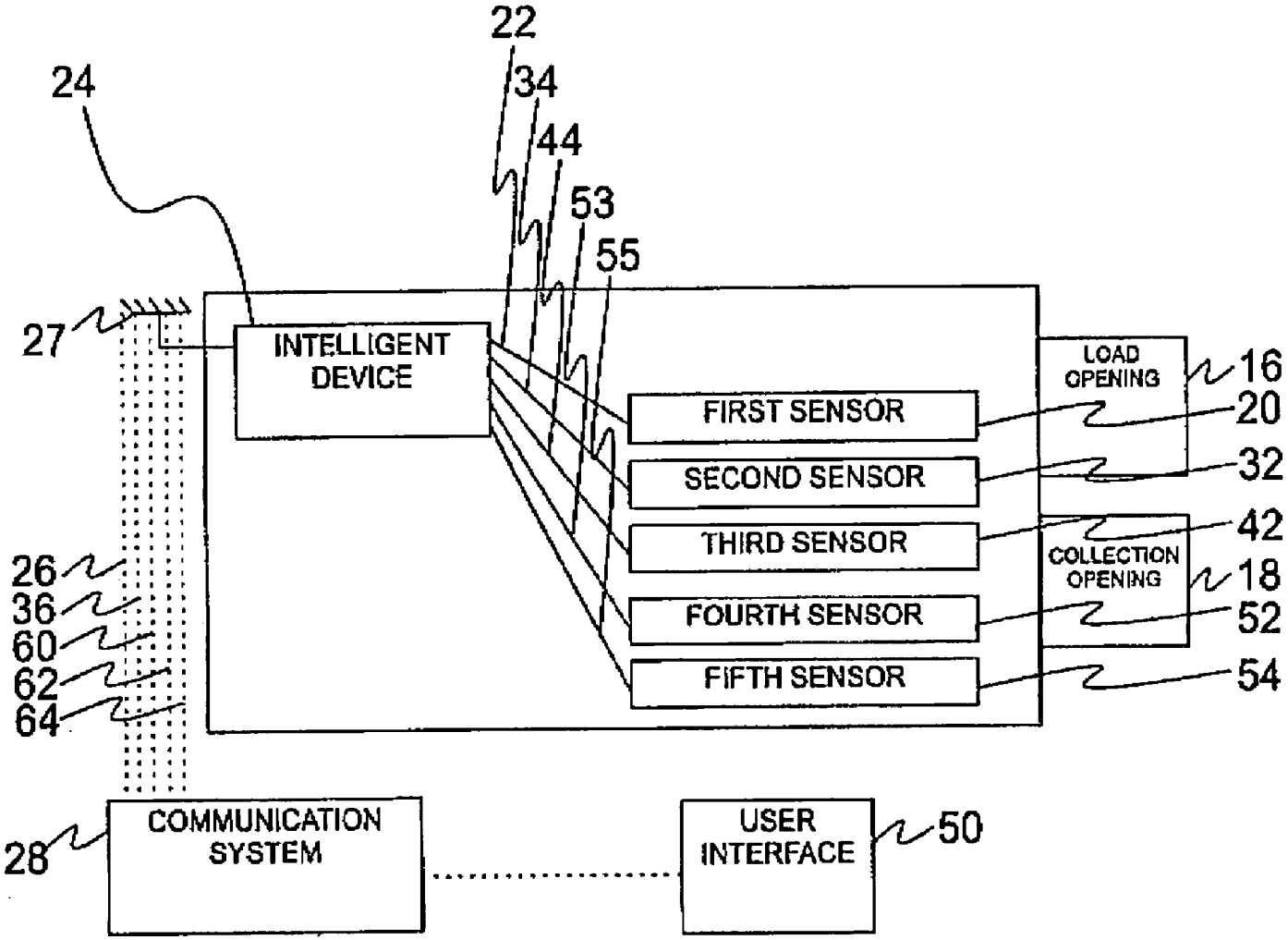
FIG. 2 is a schematic of the method.

In another embodiment, the first intelligent device signal (26) and second intelligent device signal (36) can be sent to an antenna (27), as shown in FIG. 2, prior to being sent to the software interface. The intelligent device can buffer the signal from the first sensor (20) prior to communicating the first intelligent device signal. The intelligent device in the method can be a remote terminal unit (RTU).

The user in the method can be a shipping company, trucking company, medical waste disposal company, video entertainment service company, drug store, library, grocery store, or post office.

The container (14) in the method can be a common carrier drop box, a group mail collection site, a federal post office box, or private postal box.

The communication system (28) can be the Internet, intranet, LAN, and peer-to-peer network.

As seen in FIG. 2, the method can further include using a third sensor (42) to ascertain the weight of the item (10) in the container (14). The third sensor (42) should be in communication with the intelligent device (24) with a third signal (44) and the intelligent device provides a weight notification (60) to the user interface (50).

The method can involve a fourth sensor (52) to ascertain whether the container (14) has been tampered with. The fourth sensor (52) can be in communication with the intelligent device (24) with a fourth signal (53). The intelligent device (24) provides a "tampered with" notification (62) to the user interface. The method can include a fifth sensor (54) for detecting hazardous materials. The fifth sensor (54) can be in communication with the intelligent device (24) with a fifth signal (55). The intelligent device provides a hazardous material notification (64) to the user interface (50).

In another embodiment, the method can include the step of analyzing container (14) sensor activity. The method can also involve the step of using a counter with the intelligent device to store sensor activity and report to the user interface (50) on a timed basis.

In another embodiment, the step of passing the item (10) through the loading opening (16) activating a first sensor (20) through the step of creating a first intelligent device signal (26) from the intelligent device can be repeated at least one time before continuing to the step of communicating the first intelligent device signal (26) to a communication system. Also, in another embodiment, the step of passing the item (10) through the loading opening (16) activating a first sensor (20) and the step of sending a first signal (22) from the first sensor (20) to an intelligent device can be repeated at least one time before continuing to the step of creating a first intelligent device signal (26) from the intelligent device.

While this method has been described with emphasis on the preferred embodiments, it should be understood that within the scope of the appended claims, the method might be practiced other than as specifically described herein.

What is claimed is:

1. A method for identifying the presence of an item to a user interface comprising the steps of:

a. using a container having a loading opening and a collection opening;

b. passing the item through the loading opening activating a first sensor;

c. sending a first signal from the first sensor to an intelligent device;

d. creating a first intelligent device signal from the intelligent device;

e. communicating the first intelligent device signal to a communication system, wherein said communication system is selected from the group: radio, cellular, fiber optic, satellite, and wires;

f. opening the collection opening to collect the item, thereby activating a second sensor;

g. sending a second signal from the second sensor to the intelligent device;

h. creating a second intelligent device signal from the intelligent device;

i. communicating the second intelligent device signal to the communication system; and j. using a software interface to process the first intelligent device signal and the second intelligent device signal and present the first intelligent device signal and the second intelligent device signal processed by the software interface to the user interface by a member of the group: the Internet, Intranet, phone, fax, and pager.

2. The method of claim 1, wherein the item used is a package.

3. The method of claim 1, further comprising the step of using one opening as the loading opening and the collection opening.

4. The method of claim 1, wherein the first intelligent device signal and second intelligent device signal are sent to an antenna prior to being sent to the software interface.

5. The method of claim 1, wherein the intelligent device buffers the signal from the first sensor prior to communicating the first intelligent device signal.

6. The method of claim 1, wherein the intelligent device is a remote terminal unit (RTU).

7. The method of claim 1, wherein the second sensor is manually operated to indicate the collection opening has been opened.

8. The method of claim 1, wherein the user is a member of the group: shipping company, trucking company, medical waste disposal company, video entertainment service company, drug store, library, grocery store, and post office.

9. The method of claim 1, wherein said container is a member of the group: a common carrier drop box, a group mail collection site, a federal post office box, and private postal box.

10. The method of claim 1, further comprising the step of using a third sensor to ascertain the weight of the item in the container and wherein the third sensor is in communication with the intelligent device and the intelligent device is adapted to provide a weight notification to the user interface.

11. The method of claim 1, further comprising the step of analyzing container sensor activity.

12. The method of claim 1, further comprising the step of using a fourth sensor to ascertain whether the container has been tampered with and wherein the fourth sensor is in communication with the intelligent device and the intelligent device is adapted to provide a tampered with notification to the user interface.

13. The method of claim 1, further comprising the step of using a fifth sensor for detecting hazardous materials and wherein the fifth sensor is in communication with the intelligent device and the intelligent device is adapted to provide a hazardous material notification to the user interface.

14. The method of claim 1, wherein steps (b) through (d) are repeated at least one time before continuing to step (e).

15. The method of claim 1, wherein steps (b) and (c) are repeated at least one time before continuing to step (d).

16. The method of claim 1, further comprising the step of using a counter with the intelligent device to store sensor activity and report to the user interface on a timed basis.

17. The method of claim 1, wherein the communication system is selected from the group:

Internet, intranet, LAN, and peer-to-peer network.

* * * * *